US009744640B2

(12) United States Patent
Sheelavant et al.

(10) Patent No.: US 9,744,640 B2
(45) Date of Patent: Aug. 29, 2017

(54) CORROSION RESISTANT RETAINING RINGS

(71) Applicant: Applied Materials, Inc., Santa Clara, CA (US)

(72) Inventors: Gangadhar Sheelavant, Karnataka (IN); Simon Yavelberg, Cupertino, CA (US); Yongqi Hu, Santa Clara, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 14/885,944

(22) Filed: Oct. 16, 2015

(65) Prior Publication Data

US 2017/0106495 A1 Apr. 20, 2017

(51) Int. Cl.
*B24B 37/27* (2012.01)
*B24B 37/32* (2012.01)

(52) U.S. Cl.
CPC ..... *B24B 37/32* (2013.01)

(58) Field of Classification Search
CPC ..... B24B 37/32
USPC ..... 451/398
See application file for complete search history.

(56) References Cited

U.S. PATENT DOCUMENTS 5,645,474 A * 7/1997 Kubo ..... B25B 11/005 451/287
5,695,392 A * 12/1997 Kim ..... B24B 57/02 451/285
5,749,771 A * 5/1998 Isobe ..... B24B 53/017 451/285
5,944,593 A * 8/1999 Chiu ..... B24B 37/042 451/288
6,066,197 A * 5/2000 Bristol ..... B23K 35/3612 106/14.15
6,224,472 B1 * 5/2001 Lai ..... B24B 37/32 451/288
6,471,566 B1 * 10/2002 Mikhaylich ..... B24B 37/042 451/286

(Continued)

FOREIGN PATENT DOCUMENTS

KR 10-0764040 B1 10/2007
WO 2005049274 A2 6/2005

OTHER PUBLICATIONS

"Planaredge CMP Retaining Rings", Entegris. 2009. (3 pgs.).

(Continued)

*Primary Examiner* — George Nguyen
(74) *Attorney, Agent, or Firm* — Patterson + Sheridan LLP

(57) ABSTRACT

Implementations described herein protect a retaining ring for a polishing system from corrosive polishing chemistries. In one embodiment, a retaining ring has a ring-shaped body having a top surface, an inside diameter sidewall, an outer diameter sidewall and a bottom surface. The inside diameter side wall is configured to circumscribe a substrate. The ring shaped body has a rigid ring-shaped portion, a polymeric ring-shaped portion stacked on the rigid ring-shaped portion and covering at least three sides of the rigid ring-shaped portion, a plurality of grooves formed in the bottom surface, and a plurality of wash ports formed through the polymeric ring-shaped portion, wherein the wash ports are isolated from the rigid ring-shaped portion.

14 Claims, 4 Drawing Sheets

(56) References Cited

U.S. PATENT DOCUMENTS 6,869,348 B1* 3/2005 Spiegel ..... B24B 37/32 451/287
7,857,683 B2 12/2010 Burns et al.
9,005,499 B2 4/2015 Lee et al.
2005/0126708 A1* 6/2005 Chen ..... B24B 37/32 156/345.14
2005/0208881 A1 9/2005 Wilkinson et al.
2006/0169674 A1* 8/2006 Mao ..... C09G 1/04 216/88
2006/0240750 A1* 10/2006 Oh ..... B24B 37/32 451/285
2007/0245664 A1* 10/2007 Orologio ..... B32B 3/28 52/508
2007/0248805 A1* 10/2007 Orologio ..... B32B 27/06 428/304.4
2008/0160885 A1* 7/2008 Winterlich ..... B24B 37/32 451/286
2008/0299882 A1* 12/2008 Ichinoshime ..... B24B 37/32 451/398
2009/0023362 A1* 1/2009 Chen ..... B24B 37/32 451/36
2011/0151755 A1 6/2011 Burns et al.
2013/0126050 A1* 5/2013 Wagh ..... C23C 22/68 148/253
2014/0120803 A1 5/2014 Chen et al.
2014/0287662 A1* 9/2014 Rahmathullah ..... B24B 37/32 451/398
2015/0111467 A1* 4/2015 Lin ..... B24B 37/005 451/1
2015/0252480 A1* 9/2015 Lapena Rey ..... C23C 22/34 428/447
2015/0283668 A1 10/2015 Frank, Jr.

OTHER PUBLICATIONS

Moussa, et al. "Next-Generation Materials for CMP Retaining Rings," Greene, Tweed & Co. (5 pgs.).
International Search Report and Written Opinion from PCT/US2016/053180 dated Dec. 23, 2016.

* cited by examiner

CORROSION RESISTANT RETAINING RINGS

FIELD

Embodiments of the invention relate to polishing systems for polishing a substrate, such as a semiconductor substrate. More particularly, embodiments relate to a retaining ring, a chemical mechanical planarization (CMP) system and a method for improving the life of the retaining ring.

BACKGROUND

Chemical mechanical polishing (CMP) is a process commonly used in the manufacture of high-density integrated circuits to planarize or polish a layer of material deposited on a substrate. A carrier head may provide the substrate retained therein to a polishing station of a CMP system and controllably urge the substrate against a moving polishing pad in the presence of a polishing fluid. Material is removed from the feature side of the substrate that is in contact with the polishing surface through a combination of chemical and mechanical activity. Material removed from the substrate while polishing becomes suspended in the polishing fluid. The suspended material is removed from the polishing station by the polishing fluid.

The carrier head typically includes a retaining ring that circumscribes the substrate and may facilitate holding of the substrate in the carrier head. A bottom surface of the retaining ring is typically in contact with the polishing pad during polishing. The retaining rings may have grooves to promote movement of the polishing fluid to and from the substrate. While polishing a substrate, the slurry and the removed suspended material may adhere and build up in the area between the substrate and the retaining ring. The adhered materials attack the metal surfaces of the retaining ring. Additionally, the adhered material may agglomerate and fall back onto the polishing pad and thus become a source of substrate defect.

Therefore, there is a need for an improved retaining ring, polishing system having an improved retaining ring.

SUMMARY

Implementations described herein protect a retaining ring for a polishing system from corrosive polishing chemistries. In one embodiment, a retaining ring has a ring-shaped body having a top surface, an inside diameter sidewall, an outer diameter sidewall and a bottom surface. The inside diameter side wall is configured to circumscribe a substrate. The ring shaped body has a rigid ring-shaped portion, a polymeric ring-shaped portion stacked on the rigid ring-shaped portion and covering at least three sides of the rigid ring-shaped portion, a plurality of grooves formed in the bottom surface, and a plurality of wash ports formed through the polymeric ring-shaped portion, wherein the wash ports are isolated from the rigid ring-shaped portion.

BRIEF DESCRIPTION OF THE DRAWINGS

So that the manner in which the above-recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

A retaining ring, chemical mechanical planarization system (CMP) and method for polishing a substrate are described herein. The retaining ring includes encapsulation of the metal portion to extend useable life of the retaining ring.

Figure 1:
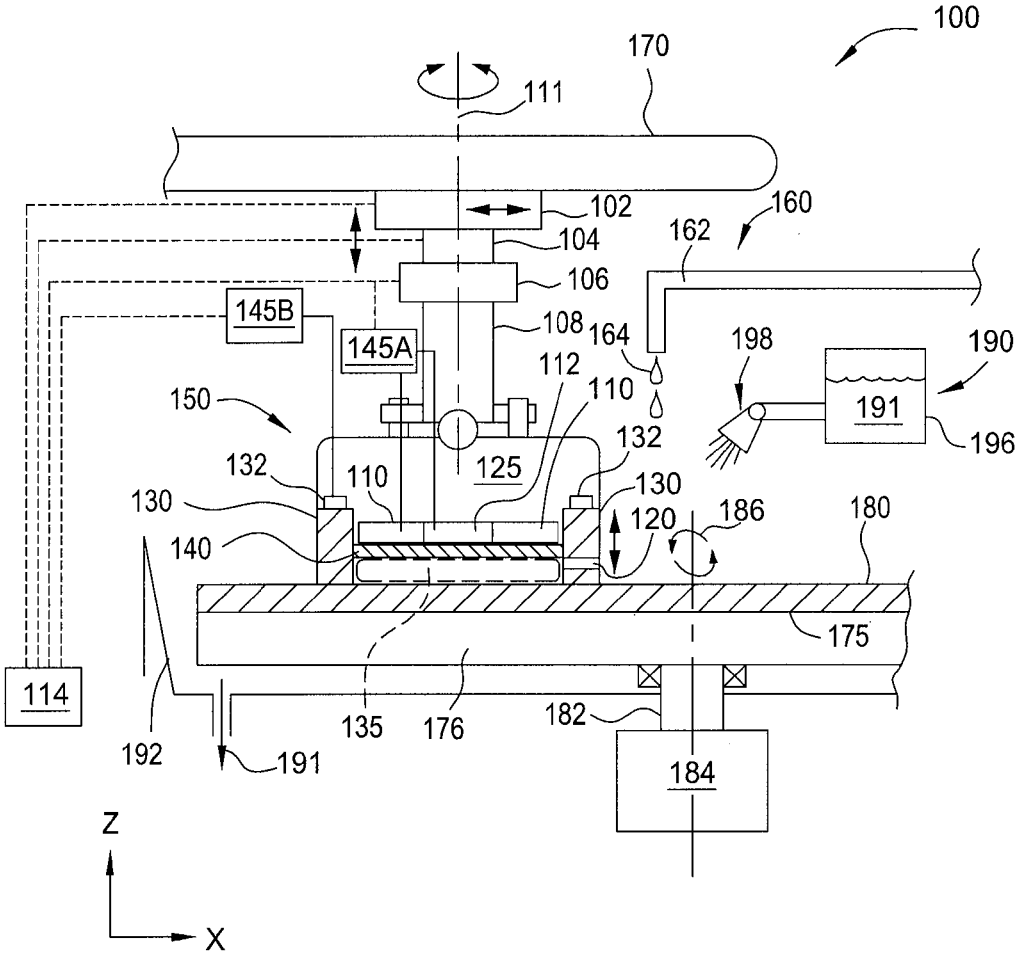
FIG. 1 is a partial cross-section view of a polishing system.

FIG. 1 is a partial cross-sectional view of a chemical mechanical polishing system (CMP) 100. The CMP system 100 includes a carrier head 150 that holds a substrate 135 (shown in phantom) inside a retaining ring 130 and places the substrate 135 in contact with a polishing surface 180 of a polishing pad 175 during processing. The polishing pad 175 is deposed on a platen 176. The platen 176 is coupled to a motor 184 by a platen shaft 182. The motor 184 rotates the platen 176 and hence, the polishing surface 180 of the polishing pad 175, about an axis 186 of the platen shaft 182 when the CMP system 100 is polishing the substrate 135.

The CMP system 100 may include a chemical delivery system 190 and a pad rinse system 160. The chemical delivery system 190 includes a chemical tank 196 which holds a polishing fluid 191, such as a slurry or deionized water. The polishing fluid 191 may be sprayed by a spray nozzle 198 onto the polishing surface 180. The polishing surface 180 rotates the polishing fluid 191 into contact with the substrate 135 that is pressed by the carrier head 150 against the polishing surface 180 in order to planarize the substrate 135. A catch basin 192 may collect the polishing fluid 191 which rotates off the polishing pad 175. The collected polishing fluid 191 may be filtered to remove impurities and transported back to the chemical tank 196 for reuse.

The pad rinse system 160 may include a water delivery tube 162 that sprays deionized water 164 onto the polishing surface 180 of the polishing pad 175. A pipe connects the water delivery tube 162 to a deionized water tank (not shown). After polishing, the deionized water 164 from the water delivery tube 162 may rinse debris and excess polishing fluid 191 from the substrate 135, the carrier head 150 and the polishing surface 180. Although the pad rinse system 160 and the chemical delivery system 190 are depicted as separate elements, it should be understood that a single system may perform both functions of delivering the deionized water 164 delivery and the polishing fluid 191.

The carrier head 150 is coupled to a shaft 108. The shaft 108 is coupled to a motor 102. The motor 102 is coupled to an arm 170. The motor 102 moves the carrier head 150 laterally in a linear motion (X and/or Y direction) relative to the arm 170. The carrier head 150 also includes an actuator 104 configured to move the carrier head 150 in a Z direction relative to arm 170 and/or the polishing pad 175. The carrier head 150 is also coupled to a rotary actuator or motor 106 that rotates the carrier head 150 relative to the arm 170 about a rotational axis that is aligned with the center line 111 of the carrier head 150. The motors/actuators 104, 102, and 106 position and/or move the carrier head 150 relative to the polishing surface 180 of the polishing pad 175. In one embodiment, the motors/actuators 104, 102, and 106 rotate the carrier head 150 relative to the polishing surface 180 and provide a down-force to urge the substrate 135 against the polishing surface 180 of the polishing pad 175 during processing.

The carrier head 150 includes a body 125 which houses a flexible membrane 140. The flexible membrane 140 provides a surface on the underside of the carrier head 150 that contacts the substrate 135. The carrier head 150 may also contain one or more bladders 110/112 disposed between the body 125 and the flexible membrane 140. The flexible membrane 140 contacts a backside of the substrate 135 when the substrate 135 is retained in the carrier head 150. The bladders 110/112 are coupled to a first variable pressure source 145A that selectively delivers a fluid to the bladders 110/112 to apply force to the flexible membrane 140. In one embodiment, the bladder 110 applies force to an outer zone of the flexible membrane 140 while the bladder 112 applies force to a central zone of the flexible membrane 140. Forces applied to the flexible membrane 140 from the bladders 110/112 are transmitted to portions of the substrate 135 and may be used to control the edge to center pressure profile that the substrate 135 asserts against the polishing surface 180 of the polishing pad 175. The first variable pressure source 145A is configured to deliver fluids to each of the bladders 110/112 independently in order to control forces through the flexible membrane 140 to discrete regions of the substrate 135. Additionally, vacuum ports (not shown) may be provided in the carrier head 150 to apply suction to the backside of the substrate 135 facilitating retention of the substrate 135 in the carrier head 150.

The body 125 and flexible membrane 140 are circumscribed by the retaining ring 130. The retaining ring 130 is coupled to the body 125 by an actuator 132. The actuator 132 is controlled by a second variable pressure source 145B. The second variable pressure source 145B provides or removes fluid from the actuator 132 which causes the retaining ring 130 to move relative to the body 125 of the carrier head 150 in the Z direction. The second variable pressure source 145B is adapted to provide the Z directional movement of the retaining ring 130 independent of movement provided by the motor 104. The second variable pressure source 145B may provide movement of the retaining ring 130 by applying negative pressure or positive pressure to the actuator 132 and/or the retaining ring 130. In one aspect, pressure is applied to the retaining ring 130 to urge the retaining ring 130 toward the polishing surface 180 of the polishing pad 175 during a polishing process from the force used to press the substrate 135 against the polishing pad 175.

The retaining ring 130 may be formed from one or more materials such as a metal, ceramic or plastic. The materials may be selected to provide rigidity and longevity to the retaining ring 130. The retaining ring 130 may have a plurality of slurry release grooves 244 (Shown in FIG. 2). The retaining ring 130 may additionally have one or more wash ports 120. The wash ports 120 and slurry release grooves 244 allows for slurry trapped in the carrier head 150 and the retaining ring 130 to be flushed out. Spraying deionized water through the wash ports 120 to clean out particles adhering to the retaining ring 130 and the flexible membrane 140, advantageously prevents particles from being reintroduced onto the polishing surface 180 which may lead to scratching or otherwise damaging a substrate during polishing.

The retaining ring 130 of the carrier head 150 contacts the polishing surface 180 and the polishing fluid 191 during polishing of the substrate 135. The chemical delivery system 190 delivers the polishing fluid 191 to the polishing surface 180 and substrate 135 during polishing. The slurry release grooves 244 and the wash ports 120 in the retaining ring 130 facilitate transportation of the polishing fluid 191 and entrained polishing debris through the retaining ring 130 and away from the substrate 135. The retaining ring 130 may be formed in a manner which protects certain materials, such as metals, comprising the retaining ring 130 from the polishing fluid 191, thus extending the life of the retaining ring 130 and reducing potential sources of process contamination.

Figure 2:
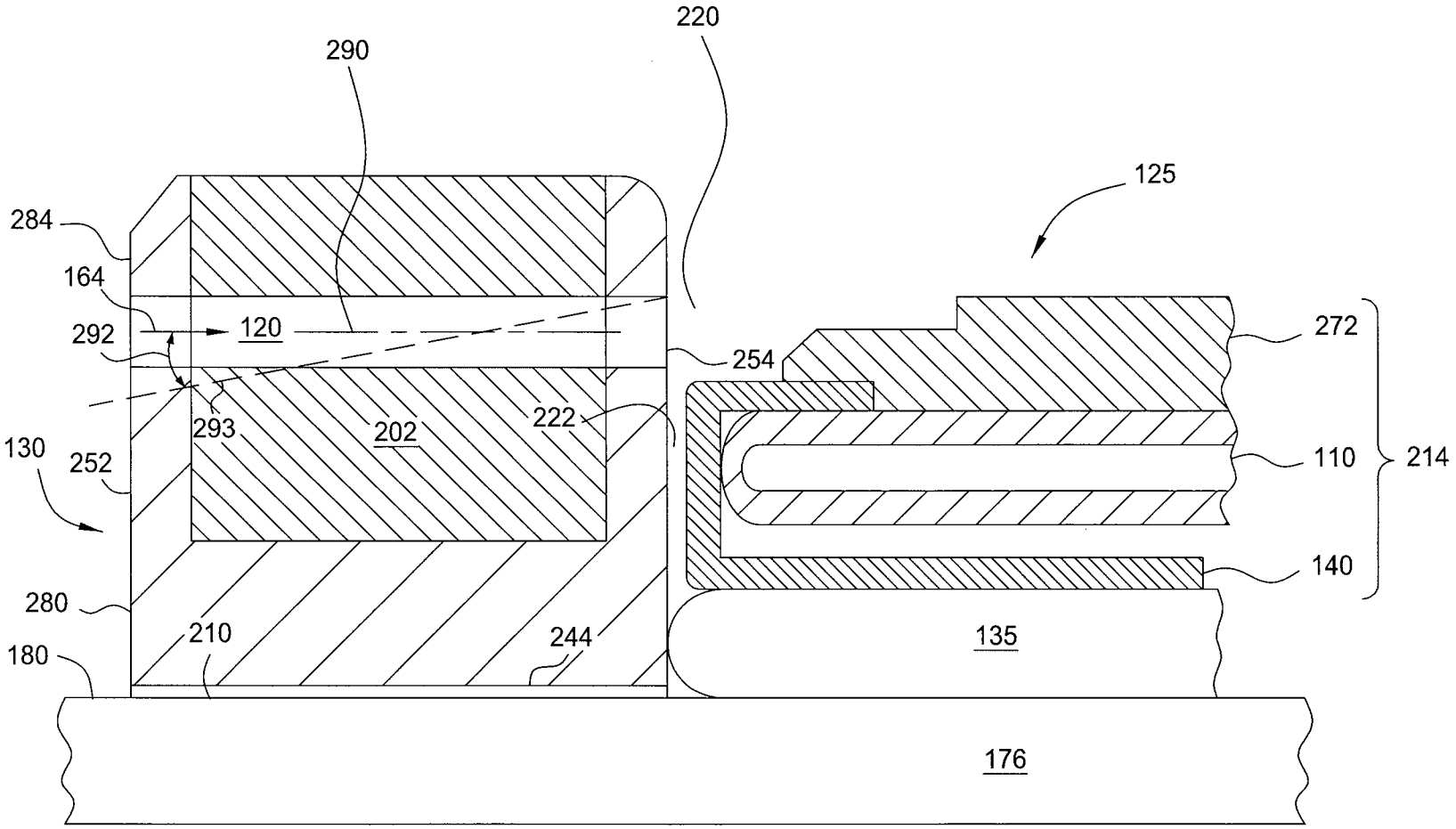
FIG. 2 is a partial cross-sectional view of a carrier head having a retaining ring.

FIG. 2 is a cross-sectional view for a portion of the carrier head 150 and the retaining ring 130. A gap 222 may be formed between the retaining ring 130 and a support structure 214 of the body 125 of the carrier head 150. The gap 222 permits the support structure 214 to move independently in a vertical direction from the retaining ring 130. Voids 220 may also exist between the support structure and the retaining ring 130. While polishing a substrate 135, polishing fluid, i.e., slurry, and particles suspended in the polishing fluid may enter in the voids 220 and gap 222. The suspended solids (particles) may become attached to the carrier head 150 in the voids 220 and gap 222. The particles entrained in the carrier head 150 may become dislodged and damage the substrate 135 during polishing if the particles are not removed.

The retaining ring 130 may be ring shaped, having a centerline concurrent with the center line 111 illustrated in FIG. 1. The retaining ring 130 may also include a bottom surface 210, an inside diameter sidewall 254 and an outer diameter sidewall 252. The inside diameter sidewall 254 has an inner radius sized to accept the substrate 135. The inside diameter sidewall 254 of the retaining ring 130 is separated from the support structure 214 by the gap 222 and the voids 220.

The retaining ring 130 may consist of a body 202 formed from two or more portions. The portions of the body 202 may include one or more pieces which fit together to form the ring shape of body 202. In one embodiment, the body 202 of the retaining ring 130 is formed from two ring-shaped portions. For example, the retaining ring 130 may have a polymer portion 280 attached to a rigid portion 284. In another embodiment, the retaining ring 130 may be formed from more than 2 portions. For example, the rigid portion 284 may be formed from a plurality of separate segments held together or encapsulated by the polymer portion 280.

The rigid portion 284 of the retaining ring 130 may be bonded to the polymer portion 280 of the retaining ring 130. In one embodiment, the rigid portion 284 is fully encapsulated by the polymer portion 280 for protecting the rigid portion 284. Such arrangements can be accomplished by molding or through additive manufacturing. In another embodiment, the rigid portion 284 is partially encapsulated by the polymer portion 280 exposing a part of the rigid portion 284 for inspection.

The rigid portion 284 may be formed from stainless steel, aluminum, molybdenum, or other metal or alloy, or a ceramic or a ceramic filled polymer plastic, or a combination of these or other suitable material. In one example, the rigid portion 284 of the body 202 may be formed from a metal, such as stainless steel (SST). The polymer portion 280, may be fabricated from a plastic material such as polyphenylene sulfide (PPS), polyethylene terephthalate, polyetheretherketone, polybutylene terephthalate, ERTALYTE® TX, PEEK, TORLON®, DELRIN®, PET, VESPEL®, DURATROL®, or a combination of these and/or other suitable material. In one example, the polymer portion 280 of the body 202 is fabricated from a plastic material to form a wear surface that contacts the pad 175 and substrate 135, while the rigid portion 284 is formed from SST to provide rigidity to the polymer portion 280.

The polymer portion 280 may additionally or alternately be formed with a hydrophobic material or coating that resists chemical interaction with process fluids, such as a polymeric material selected based on the chemistry of the polishing fluid used to process the substrate 135 in the CMP system 100. The polymeric material may be a carbon-containing material such as parylene (polyparaxylylene), or other carbon-containing materials such as PEEK (polyether ether ketones) and diamond-like carbon (DLC). The coating is discussed in greater detail with regards to FIGS. 5A and 5B.

Continuing to refer to FIG. 2 and as briefly discussed above, the body 202 may include slurry release grooves 244 formed in the bottom surface 210. The slurry release grooves 244 extend from the inside diameter sidewall 254 to the outer diameter sidewall 252. Upon rotation of the retaining ring 130, the polishing fluid 191 and any entrained polishing debris such as material remove by polishing from the substrate 135 is inclined to move through the slurry release grooves 244 due to the rotation of the pad 175 and the carrier head 150.

The wash ports 120 may be formed in any portion of the body 202. The wash ports 120 have a first centerline 290 that may be substantially perpendicular to the center line 111 of the carrier head 150 (and thus, the centerline of the retaining ring 130). The wash port 120 provides a pathway for cleaning fluid (i.e., deionized water 164) directed at the outer diameter sidewall 252 of the retaining ring 130 to pass through the body 202 of the retaining ring 130 and enter into the voids 220 and gap 222 defined within the carrier head 150. The wash port 120 is sized to provide a flow of the cleaning fluids sufficient to remove the entrained polishing debris which may have become trapped in the voids 220 and gap 222 of the carrier head 150. The wash port 120 may be oriented such that the first centerline 290 parallels a top polishing surface 180 of the polishing pad 175. Alternatively, the wash port 120 may be inclined at a vertical angle 292 such that the first centerline 290 is rotated to a position of a second centerline 293 and the wash port 120 is angled upward from the outer diameter sidewall 252. The vertical angle 292 for the wash port 120 relative to the first centerline 290 (or a horizontal) may be about greater than −80 degrees and less than about 80 degrees, such as +/−30 degrees.

The number and configuration of wash ports 120 may be configurable and/or dependent on process conditions. For example, the retaining ring 130 may have up to 18 or more spaced wash ports 120 to permit solids adhered to the carrier head 150 to be washed out and away from the carrier head 150. The wash ports 120 may be equally or otherwise spaced about the retaining ring 130 to ensure all surfaces of the voids 220 and gap 222 of the carrier head 150 can be flushed with the cleaning fluid. The wash ports 120 may also be formed in small groups, such as groups of four or five wash ports 120, and the groups may be spaced apart to provide room for fasteners or other components, such as portions of the rigid portion 284 as shown in FIGS. 4A through 6A discussed further below.

Figure 3:
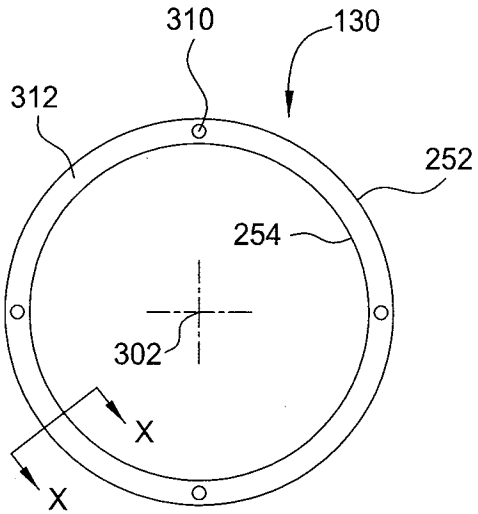
FIG. 3 is a top view of the retaining ring.

FIG. 3 is a top view for the retaining ring 130. The retaining ring 130 may have a center 302. The retaining ring 130 has a top surface 312. The top surface 312 may have one or more mounting features 310. The mounting features 310 may extend into the polymer portion 280 of the body 202. Alternately, the mounting feature 310 may extend into the rigid portion 284 of the body 202. The mounting features 310 may be a hole, tab or other feature suitable for attaching the retaining ring 130 to the actuator 132. The retaining ring 130 has a cross section X-X which is radially aligned with the center 302.

FIG. 4A through FIG. 6B illustrate different embodiments of the corrosion resistant retaining ring 130 taken through cross section X-X. In one or more embodiments depicted in FIGS. 4A through 6B, the polymer portion 280 is formed from a plastic material and the rigid portion 284 is formed from a metal, such as stainless steel. Advantageously, the material of the polymer portion 280 protects the rigid portion 284 from the corrosive fluids flowing through the wash ports 120 of the retaining ring 130 for promoting longevity of the retaining ring 130. Meanwhile, the material of the rigid portion 284 provides structural rigidity to the retaining ring 130.

Figure 4A:
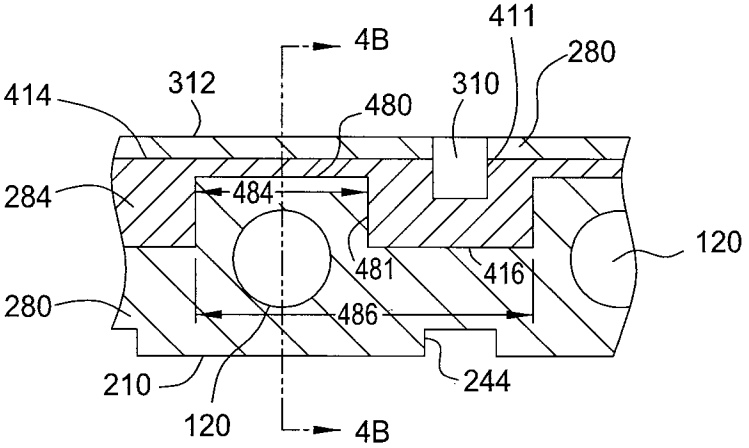
FIGS. 4A and 4B are cross-sectional views depicting one embodiment of a corrosion resistant retaining ring.
Figure 4B:
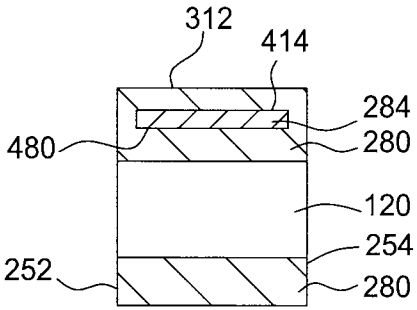

FIGS. 4A and 4B are cross-sectional views depicting one embodiment of the corrosion resistant retaining ring 130. The retaining ring 130 is exposed to working fluids and has wash ports 120 and slurry release grooves 244 which direct the fluids across the retaining ring 130. FIGS. 4A and 4B illustrate an embodiment of the retaining ring 130 having the rigid portion 284 encapsulated by the polymer portion 280 and the wash ports 120 disposed through the polymer portion 280. That is, the rigid portion 284 is completely encased and surrounded by the polymer portion 280.

The rigid portion 284 has a top surface 414 and a bottom surface 416. The bottom surface 416 may have a profile 480. The profile 480 may be irregular or regular such as a waveform. The profile 480 may have protrusions 481 which extend the polymer portion 280 into the bottom surface 416 of the rigid portion 284. The profile 480 may have protrusions 481 which form a square, sinusoidal or other shape pattern. In one embodiment, the bottom surface 416 of the rigid portion 284 has substantially rectangular protrusions 481 in the profile 480. Advantageously, the protrusions 481 of the polymer portion 280 extending into the bottom surface 416 of the rigid portion 284 provide space to accommodate the wash ports 120 formed through the polymer portion 280. Thus, the wash ports 120 are isolated from the rigid portion 284, and thus chemicals and other materials flowing through the wash ports 120 cannot contact the rigid portion 284 of the retaining ring 130.

The profile 480 may have a period 486. The period 486 is a measure of the distance between the beginning of adjacent protrusions 481. The period 486 may be short wherein the adjacent protrusions 481 are close together. Alternately, the period 486 may be long wherein the adjacent protrusions 481 are further apart. The period 486 may be regular and thus occur at substantially similar intervals along the entire bottom surface 416 of the rigid portion 284. A regular period 486 may be indicative of the profile 480 having a regular waveform. Alternately, the period 486 may vary to accommodate the placements of the wash ports 120 or groups of wash ports 120.

The protrusions 481 may be separated by a width 484. The width 484 may be configured to allow the formation of one or more wash ports 120 between protrusions 481. In one embodiment, the width 484 is configured for the formation of one wash port 120. In another embodiment, the width is configured for the formation of two or more wash ports 120, such as four wash ports 120. In some embodiments, the width 484 of the protrusions 481 of the of the polymer portion 280 is substantially similar in size. In other embodiments, the width 484 of the protrusions 481 of the polymer portion 280 may be sized differently. For example, the protrusions 481 may each accommodate a different number of wash ports 120, such as one wash port 120 in one location of the retaining ring 130 and two wash ports 120 in another location of the retaining ring 130.

The rigid portion 284 may optionally have a receiver 410 for the mounting feature 310. The receiver 410 is shown as a hole but may alternately be a stud, pin or other externally protruding feature. The receiver 410 may be threaded or have another feature allowing the fastener to attach the retaining ring 130 to the carrier head 150. Advantageously, the receiver 410 being formed in the material of the rigid portion 284 which provides a stronger anchoring point for attaching the retaining ring 130 to the carrier head 150 than if the receiver had been formed in the softer material of the polymer portion 280.

Advantageously, the rigid portion 284 may be formed of a rigid material such as SST and be fully encapsulated by a plastic protective material of the polymer portion 280. The protrusions 481 in the bottom surface 416 of the rigid portion 284 permits the formation of the wash ports 120 in the retaining ring 130 without exposing the rigid portion 284 to the corrosive working fluids. Thus, the longevity of the retaining ring 130 is extended beyond conventional retaining rings where the rigid portion 284 is exposed to corrosive working fluids.

Figure 5A:
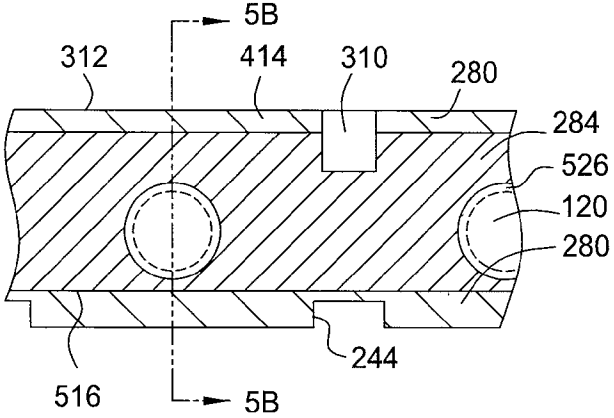
FIGS. 5A and 5B are cross-sectional views depicting another embodiment of the corrosion resistant retaining ring.
Figure 5B:
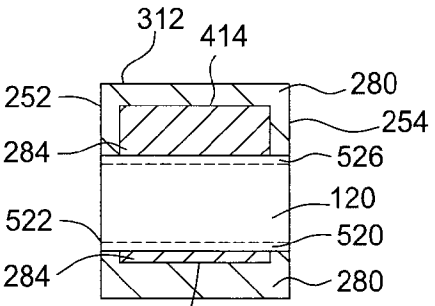

FIGS. 5A and 5B are cross-sectional views depicting another embodiment of the corrosion resistant retaining ring 130. The retaining ring 130 is exposed to working fluids and has wash ports 120 and slurry release grooves 244 which direct the fluids across the retaining ring 130. FIGS. 5A and 5B illustrate an embodiment of the retaining ring 130 having the rigid portion 284 encapsulated by the polymer portion 280 and the wash ports 120 disposed through the polymer portion 280 and rigid portion 284.

The rigid portion 284 has a top surface 414 and a bottom surface 516. The top surface 414 and bottom surface 516 may be substantially parallel with the top surface 312 of the retaining ring 130. The rigid portion 284 may have a hole 520 disposed therethrough. The polymer portion 280 may have a hole 522 which substantially aligns with the hole 520 in the rigid portion 284. The wash port 120 extends through the holes 520, 522 from the inside diameter sidewall 254 to the outer diameter sidewall 252.

Wash ports 120 may be formed through the polymer and the rigid portion 280, 284. A coating 526 may be disposed on the holes 520, 522 and in particular, the hole 520 exposing the rigid portion 284 to the wash port 120. The coating 526 lines the passageway of the wash port 120 to prevent fluids flowing therethrough from coming into contact with the rigid portion 284 of the retaining ring 130. The coating 526 may be formed from a polymeric material such as a carbon-containing material. The carbon containing material may include parylene (polyparaxylylene), for example Parylene C (chlorinated linear polyparaxylylene), Parylene N (linear polyparaxylylene), and Parylene X (cross-linked polyparaxylylene). Other carbon-containing materials which may be used include PEEK (polyether ether ketones) and diamond-like carbon (DLC). The coating 526 protects the rigid portion 284 from corrosion due to the chemistries flowing through the wash port 120.

The coating 526 may be applied in an additive manufacturing operation, such as during a printing process used to form the retaining ring 130. Alternately, the coating 526 may be applied by spraying, dipping or other suitable method. In another alternative, the coating 526 may be integral and continuous part of the polymer portion 280. For example, the coating 526 may be formed in an over-molding process wherein the rigid portion 284 is over molded with the polymer portion 280. Advantageously, the coating 526 protects the rigid portion 284 from the chemistries flowing through the wash port 120 and prevents fluids from attacking and degrading the rigid portion 284. Thus, the coating 526 extends the service life of the retaining ring 130.

Figure 6A:
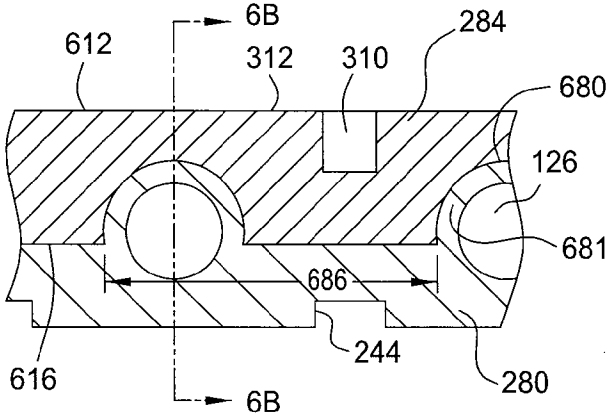
FIGS. 6A and 6B are cross-sectional views depicting yet another embodiment of the corrosion resistant retaining ring.
Figure 6B:
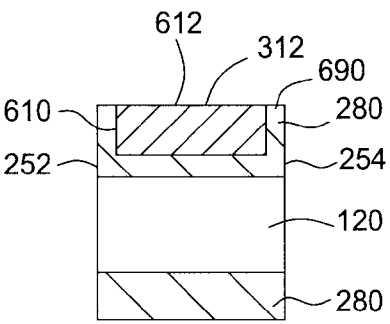

FIGS. 6A and 6B are cross-sectional views depicting yet another embodiment of the corrosion resistant retaining ring 130. The retaining ring 130 is exposed to working fluids and has wash ports 120 and slurry release grooves 244 which direct the fluids across the retaining ring 130 from the inside diameter sidewall 254 to the outer diameter sidewall 252. FIGS. 6A and 6B illustrate an embodiment of the retaining ring 130 wherein the rigid portion 284 is partially encapsulated by the polymer portion 280 and the wash ports 120 are disposed through the polymer portion 280.

The rigid portion 284 has a top surface 612 and a bottom surface 616. The bottom surface 616 may have a profile 680 similar to that described in reference to FIG. 4. The profile 680 may have protrusions 681, extending from the polymer portion 280, extend into the bottom surface 616 of the rigid portion 284. The protrusions 681 may be rectangular, semi-circular, or other suitable shape. In one embodiment, the bottom surface 616 of the rigid portion 284 has substantially semi-circular protrusions 681 forming the profile 680. Advantageously, the protrusions 681 of the polymer portion 280 that extend into the bottom surface 616 of the rigid portion 284, provide space for the formation of the wash ports 120 formed through the polymer portion 280 without the wash port 120, thereby preventing the rigid portion 284 from being exposed to chemicals flowing through the wash ports 120.

The protrusions 681 of the profile 680 may have a period 686. The period 686 may be regular or irregular as discussed above to accommodate the placements of the wash ports 120. The protrusions 681 may be configured to allow the formation of one or more wash ports 120 in each protrusion 681. In one embodiment, the protrusions 681 are configured for the formation of one wash port 120. In another embodiment, the protrusions 681 are configured for the formation of two or more wash ports 120, such as three wash ports 120. In some embodiments, the protrusions 681 of the rigid portion 284 are substantially similar in size to adjacent protrusions 681. In other embodiments, the protrusions 481 of the rigid portion 284 may be sized differently.

The top surface 612 of the rigid portion 284 may be coincident with the top surface 312 of the retaining ring 130. The mounting feature 310 in the top surface 612, secures the retaining ring 130 to the carrier head 150. The polymer portion 280 may encapsulate all but the top surface 612 of the rigid portion 284. Sides 690 of the polymer portion 280 forms an opening 610 in which the rigid portion 284 is disposed in. The rigid portion 284 may be configured to snap into and out of the opening 610 of the polymer portion 280. The sides 690 protect all but the top surface 612 of the rigid portion 284 from exposure to the processing chemistries.

The top surface 612 is mounted to the carrier head 150 and the carrier head 150 substantially protects the top surface 612 of the rigid portion 284 from exposure to the processing chemistries. Advantageously, having the top surface 612 of the rigid portion 284 exposed in the retaining ring 130 allows easy assembly and independent replacement of the polymer portion 280 and/or rigid portion 284 of the retaining ring 130.

While the foregoing is directed to embodiments of the invention, other and further embodiments of the invention may be devised without departing from the basic scope thereof.

What is claimed is:

1. A retaining ring for a polishing system, the retaining ring comprising:

a ring-shaped body having a top surface, an inside diameter sidewall, an outer diameter sidewall and a bottom surface, the inside diameter side wall configured to circumscribe a substrate; wherein the ring shaped body comprises:

a rigid ring-shaped portion;

a polymeric ring-shaped portion stacked on the rigid ring-shaped portion and covering at least three sides of the rigid ring-shaped portion;

a plurality of grooves formed in the bottom surface, and a plurality of wash ports formed through the polymeric ring-shaped portion, wherein the wash ports are isolated from the rigid ring-shaped portion by a polymeric material continuous with the polymeric ring-shaped portion.

2. The retaining ring of claim 1, wherein the wash ports are non-perpendicular relative to a centerline of the ring-shaped body.

3. The retaining ring of claim 1, wherein the polymeric ring-shaped portion comprises:

protrusions extending into the rigid ring-shaped portion, the wash ports formed through the protrusions.

4. The retaining ring of claim 3, wherein an inside diameter of the wash ports are covered by the polymeric ring-shaped portion, the polymeric ring-shaped portion comprised by the polymeric material.

5. The retaining ring of claim 1, wherein the rigid ring-shaped portion is completely encapsulated by the polymeric ring-shaped portion, the polymeric ring-shaped portion comprised by the polymeric material.

6. The retaining ring of claim 1 further comprising:

a polymeric coating formed in an inside diameter of the wash ports, the polymeric coating isolating the rigid ring-shaped portion from the wash ports, the polymeric coating comprised by the polymeric material.

7. A retaining ring for a polishing system, the retaining ring comprising:

a ring-shaped body having a top surface, an inside diameter sidewall, an outer diameter sidewall and a bottom surface, the inside diameter side wall configured to circumscribe a substrate; wherein the ring shaped body comprises:

a metal ring-shaped portion;

a polymeric ring-shaped portion covering the exterior of the rigid ring-shaped portion;

a plurality of grooves formed in the bottom surface of the ring-shaped body, and a plurality of wash ports formed through the polymeric ring-shaped portion, wherein the wash ports are isolated from the metal ring-shaped portion by a polymeric material continuous with the polymeric ring-shaped portion.

8. The retaining ring of claim 7, wherein the wash ports are non-perpendicular relative to a centerline of the ring-shaped body.

9. The retaining ring of claim 7, wherein the polymeric ring-shaped portion comprises:

protrusions extending into the metal ring-shaped portion, the wash ports formed through the protrusions.

10. The retaining ring of claim 9, wherein an inside diameter of the wash ports are covered by the polymeric ring-shaped portion, the polymeric ring-shaped portion comprised by the polymeric material.

11. The retaining ring of claim 7, wherein the metal ring-shaped portion is completely encapsulated by the polymeric ring-shaped portion, the polymeric ring-shaped portion comprised by the polymeric material.

12. The retaining ring of claim 7 further comprising:

a polymeric coating formed in an inside diameter of the wash ports, the polymeric coating isolating the metal ring-shaped portion from the wash ports, the polymeric coating comprised by the polymeric material.

13. The retaining ring of claim 7, wherein the metal ring-shaped portion is fabricated from stainless steel.

14. The retaining ring of claim 13, wherein the polymeric ring-shaped portion is fabricated at least one of polyphenylene sulfide (PPS), polyethylene terephthalate, polyetheretherketone, and polybutylene terephthalate.

* * * * *